United States Patent [19]

Richardson

[11] 4,237,812

[45] Dec. 9, 1980

[54] JET SKI GRATING

[76] Inventor: Jerald S. Richardson, 11461 Biscayne Blvd., Garden Grove, Calif. 92641

[21] Appl. No.: 946,493

[22] Filed: Sep. 28, 1978

[51] Int. Cl.[3] ..... B63H 11/02; B63H 11/10

[52] U.S. Cl. ..... 440/38; 440/47

[58] Field of Search ..... 115/11, 12 R, 12 A, 115/14, 16, 70; 60/221, 222

[56] References Cited

U.S. PATENT DOCUMENTS

| | | | |
|---|---|---|---|
| 3,040,695 | 6/1962 | Austin | 115/14 |
| 3,147,733 | 9/1964 | Engel | 115/11 X |
| 3,292,373 | 12/1966 | Tado | 115/14 X |
| 3,826,220 | 7/1974 | Jacobson | 115/70 |
| 3,942,463 | 3/1976 | Johnson, Jr. et al. | 115/11 |

*Primary Examiner*—Sherman D. Basinger

*Attorney, Agent, or Firm*—Christie, Parker & Hale

[57] ABSTRACT

A jet ski has a hull, a motor mounted in the hull for driving a pump in an aft section of the hull, and a well formed in the bottom of the hull in front of an opening to the pump impeller. A grating which covers the well has a scoop below and in front of an opening to the pump housing for scooping water and directing it toward the impeller during use. Water from the impeller is forced under pressure through a jet nozzle aft of the impeller for providing motive power for the hull. The scoop has a concavely curved, inclined surface with a continuous and uninterrupted bottom edge projecting below the plane of the hull bottom surface, which results in increased velocity of the ski.

13 Claims, 7 Drawing Figures

16
10
2
14
12
2

12
64
26
39
50
42
3
30
64
20
62
32
3
18

4
30
5
60
34
36
39
26
20
67
50
28
48
66
42
56
52
122
5
4
124
32

39
52
48
50
39

JET SKI GRATING

BACKGROUND

This invention relates to jet skis, and more particularly, to an improved grating for controlling the inlet of water to a pump impeller and jet nozzle on a jet ski.

Recently, jet skiing has become a popular water sport. A jet ski provides its own motive power, and therefore the rider can ski without requiring the aid of others, such as in water skiing.

A jet ski has a hull similar in shape to a boat, and the rider stands or crouches near the aft end of the hull when skiing. A gasoline engine mounted in the hull in front of the rider drives a pump impeller in the aft section of the hull. A well formed in the bottom of the hull is covered by a grating which aids in scooping water and directing it through the well and into the impeller blades. The impeller forces the water through a jet nozzle behind the impeller for providing motive power for the ski. The rider steers the jet ski by a steering mechanism which controls deflection of a steering nozzle at the aft end of the hull.

At the present time, jet skis can travel over 30 miles an hour, and jet ski racing has recently become a popular form of competition. The present invention is based on a recognition that the speed of a jet ski can be increased significantly by an improved grating structure provided by this invention. The jet ski of this invention has proved to be an improvement over the jet ski Series JS 440-A manufactured by Kawasaki Motors Corp.

SUMMARY OF THE INVENTION

Briefly, this invention provides a jet ski having a hull with a generally flat bottom surface adjacent a well formed in the bottom of the hull, a pump aft of an opening in the well for providing motive power for the jet ski in water, and a grating secured over the well in front of the opening to the pump. The grating has a scoop for directing water through the opening and toward the pump. The scoop has a concavely curved bottom edge that projects below the plane of the hull bottom surface. The bottom edge of the scoop is generally at the point of maximum spacing between the bottom surface of the hull and the bottom surface of the grating. The concave edge of the scoop is continuous and uninterrupted across substantially the entire width of the scoop surface, providing an opening within the grating which is essentially entirely open from the scoop to the forward end of the grating. The grating structure results in increased speed of the jet ski when compared with the Kawasaki Series JS 440-A jet ski referred to above.

These and other aspects of the invention will be more fully understood by referring to the following detailed description and the accompanying drawings.

DRAWINGS

DETAILED DESCRIPTION

Figure 1:
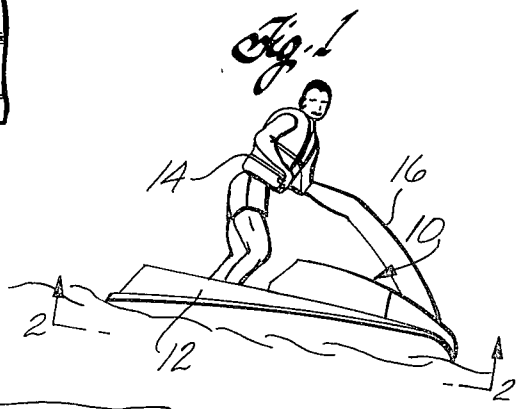
FIG. 1 is a schematic view showing a jet ski.

FIG. 1 shows a jet ski 10 having a hull 12 on which a rider 14 can stand when riding the jet ski. The rider operates a steering mechanism 16 which, in turn, controls deflection of a steering nozzle 18 (see FIG. 2) at the aft end of the hull. A gasoline engine (not shown) is mounted in the hull forward of where the rider stands.

Figure 2:
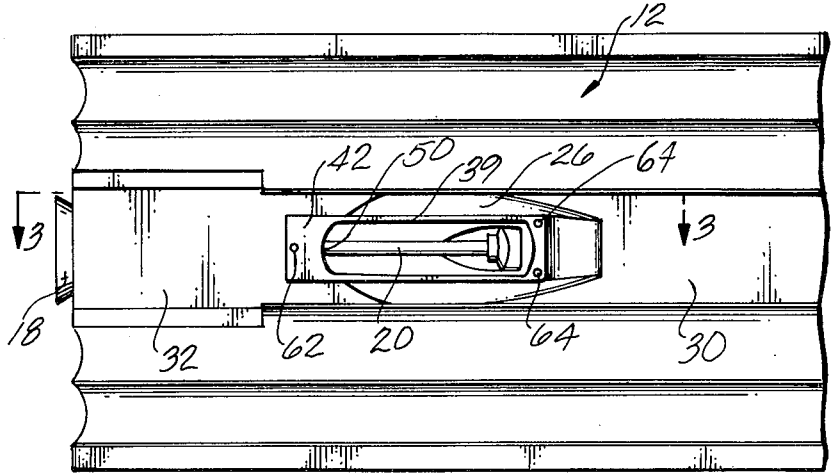
FIG. 2 is a fragmentary bottom elevation view taken on line 2—2 of FIG. 1 and showing a portion of a jet ski having a grating according to principles of this invention.
Figure 3:
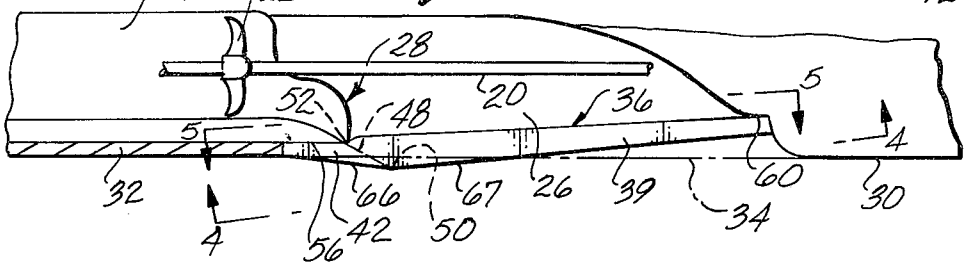
FIG. 3 is a fragmentary semi-schematic side elevation view taken on line 3—3 of FIG. 2.

Referring to FIGS. 2 and 3, a drive shaft 20 driven by the engine extends toward the aft end of the hull where the shaft is coupled to an impeller 22. The impeller is contained in a pump housing 24 in the aft section of the hull behind a well 26 formed in the bottom of the hull. The well has an aft opening 28 to the pump housing so that water flowing through the well can pass through the opening toward the impeller. A jet nozzle (not shown) is coupled to the aft end of the pump housing, and the steering nozzle swivels about a vertical axis through the aft end of the jet nozzle. Water forced through the nozzles provides motive power for the hull in water.

The hull has a generally flat bottom surface 30 extending fore and aft of the well. The flat bottom surface of the hull adjacent the aft end of the well is actually formed by a pump housing cover plate 32. The cover plate and the bottom surface portion of the hull forward of the well are in a common plane, as illustrated by the phantom line 34 in FIG. 3. The bottom surface of the hull adjacent the fore and aft ends of the well is flat essentially for approximately the same width as the well itself. This configuration is best depicted in FIG. 2.

The lower portion of the well is covered by a grating 36 according to principles of this invention. The construction of the grating is understood best by referring to FIGS. 3 through 7. The grating comprises a piece of metal of generally long and narrow rectangular shape, with a long and narrow generally rectangular opening 38 extending through most of the length of the grating. A pair of long and narrow parallel side bars 39 extend along opposite sides of the grating. The side bars deflect large foalting debris during use to keep it from entering the pump. A generally narrow front mounting bar 40 at the forward end of the grating integrally connects the forward ends of the side bars 39. A generally rectangular aft mounting plate 42 at the aft end of the grating integrally connects the aft ends of the side bars 39. A separate threaded bore 44 extends through each end of the front mounting bar 40 near the corners formed between the mounting bar and the side bars 39. A single threaded bore 46 extends through the aft mounting plate 42 on the grating centerline and near the aft end of the grating.

A scoop 48 is formed at the aft end of the opening 38 in the grating. The surface of the scoop faces toward the forward end of the grating and the surface of the scoop is angled so that it faces upwardly toward the well 26. Stated another way, the scoop surface intersects the bottom surface of the grating to form a curved bottom edge 50. The scoop surface is inclined upwardly and in the aft direction away from the curved bottom edge to form a correspondingly curved top edge 52 which intersects the top surface of the grating. The curved top and bottom edges of the scoop are curved concave inwardly toward the aft mounting plate 42 when the grating is viewed from above as in FIG. 5. The opening 38 in the grating is entirely uninterrupted from end-to-end, i.e., from the surface of the scoop 48 to the mounting bar 40 at the front end of the grating. The scoop surface also is continuous and uninterrupted from one side to the other, i.e., from its juncture with one side bar 39 to its juncture with the other side bar 39. In one embodiment, the concave bottom edge 50 of the scoop is continuous and uninterrupted for a distance of about 1⅛ to 1¼ inches.

The aft mounting plate 42 has a flat top surface 54 for contact with a corresponding flat surface 56 at the base of the pump housing, when the aft end of the grating is secured over the well. Similarly, the front mounting bar 40 has a flat top surface 58 for lying flat against a corresponding flat surface 60 inside a front portion of the well. As shown in FIG. 2, a fastener 62 secures the aft mounting plate of the grating to surface 56 at the base of the pump housing, and fasteners 64 secure the front mounting bar of the grating to the surface 60 near the forward end of the well.

Figure 7:
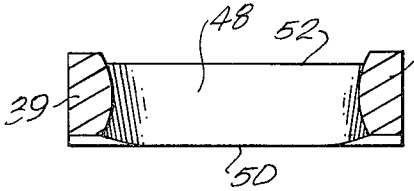
FIG. 7 is a cross-sectional view taken on line 7—7 of FIG. 5.
Figure 6:
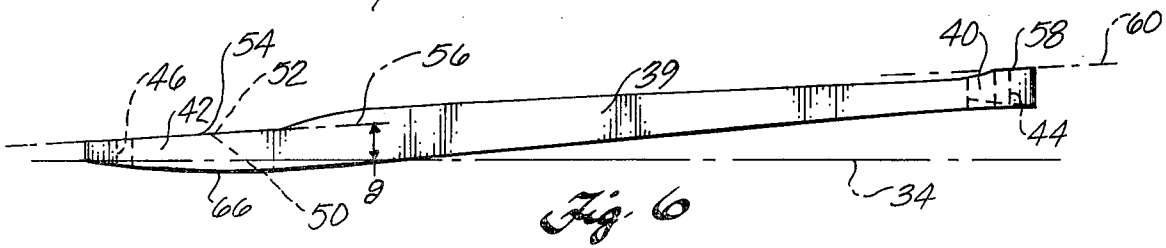
FIG. 6 is a side elevation view taken on line 6—6 of FIG. 5.

When the grating is viewed from the side, as in FIG. 6, the aft mounting plate 42 tapers wider from the aft end of the grating toward the bottom edge 50 of the scoop, and then the side bars 39 generally taper narrower away from the scoop bottom edge 50 toward the forward end of the grating. When the grating is secured over the well, as illustrated best in FIGS. 3 and 6, a tapering aft bottom surface 66 of the grating projects below the plane 34 of the hull bottom surface adjacent the aft side of the scoop bottom edge 50, and a tapering forward bottom surface 67 of the grating side bars projects below the plane 34 adjacent the forward side of the scoop. The aft bottom surface 66 of the grating which extends from the aft end of the grating toward the bottom edge 50 of the scoop gradually projects farther below the plane 34 of the hull bottom surface. The bottom edge 50 of the scoop is generally at the point of maximum vertical spacing between the plane 34 of the hull bottom surface and the bottom surface of the grating. The forward portion 67 of the grating bottom surface extending in a forward direction away from the scoop bottom edge 50 gradually tapers closer toward the plane 34 of the hull bottom surface. Thus, the curved bottom edge 50 projects below portions of the flat bottom surface of the hull both forward and aft of the well 26; and the curved bottom edge 50 is continuous and uninterrupted from one side to the other at the point of maximum spacing below the hull bottom surface, as shown in FIG. 7.

Referring to FIG. 3, the grating is mounted over the well 26 so that the surface of the scoop projects in a forward direction away from the bottom of the opening 28 to the pump housing 24. The angle of the scoop surface deflects water upwardly toward the opening to the pump housing. The surface 56 to which the aft mounting plate 42 is attached is not quite parallel to the plane 34 of the hull bottom, and the surface 60 to which the front mounting bar 60 is secured is slightly askew to the hull bottom plane 34. When the grating is mounted over the well, the top surface of the front mounting bar 60 is about 0.35 inch above the top surface of the aft mounting plate 42. At the aft edge of the grating, the bottom surface of the grating lies in the plane 34 of the hull bottom surface. From that point forward, the bottom surface of the grating tapers progressively farther below the bottom of the hull up to the vicinity of the scoop bottom edge 50. Forward of the scoop bottom edge 50 the side bars 39 then progressively taper closer toward the plane of the hull bottom surface, and a substantial length of the side bars extends upwardly into the well above the plane of the hull bottom surface.

Figure 4:
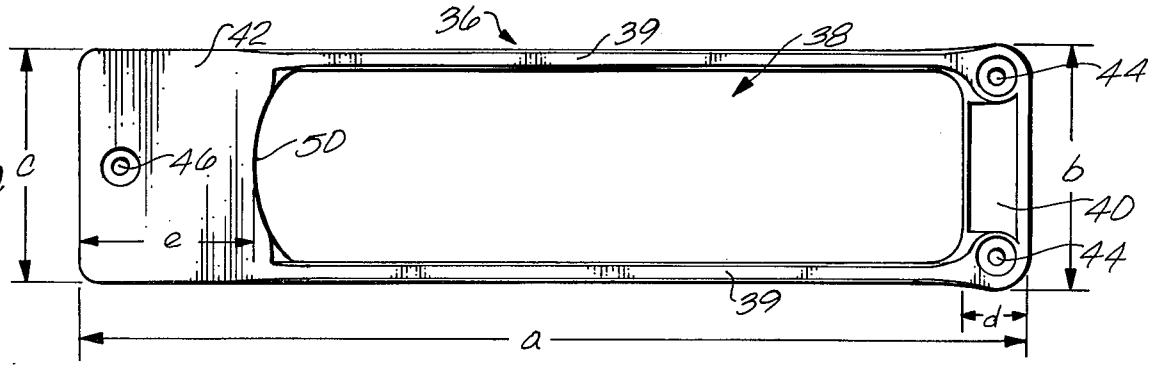
FIG. 4 is a bottom elevation view taken on line 4—4 of FIG. 3 and showing the grating of this invention.
Figure 5:
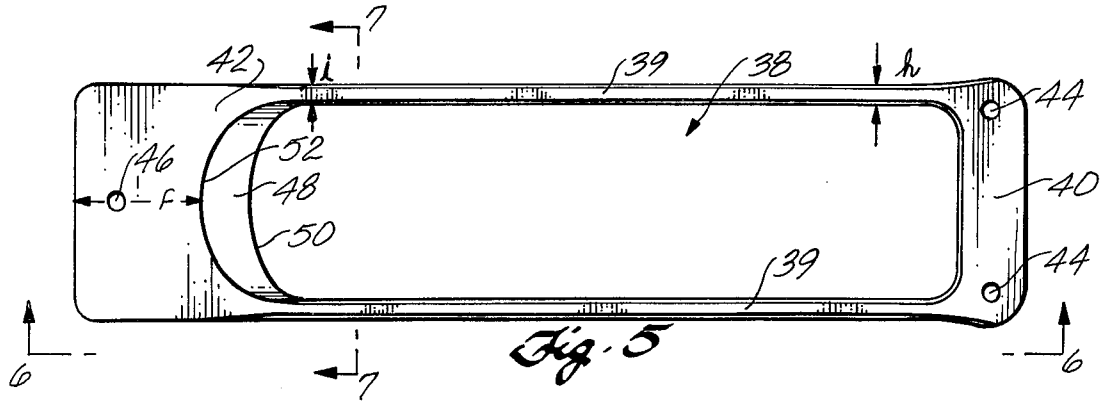
FIG. 5 is a top elevation view taken on line 5—5 of FIG. 3.

In one embodiment of the grating, the grating is about 12 inches in overall length (dimension a in FIG. 4). The grating is about 3.10 inches in width at its front end (dimension b in FIG. 4) and about 2.95 inches in width at its aft end (dimension c in FIG. 4). The forward mounting bar 40 has a width of about 0.75 inch (dimension d in FIG. 4). The curved bottom edge 50 of the scoop (at its center) is approximately 2.25 inches in front of the aft end of the grating (dimension e in FIG. 4), and the top edge 52 of the scoop surface is approximately 1.6 inches from the aft end of the grating (dimension f in FIG. 5). This provides a scoop angle of about 45° with respect to a vertical line through the bottom edge of the scoop. In the embodiment shown, the depth of the grating bottom edge 50 below the top surface of the grating (dimension g in FIG. 6) is approximately 0.54 inch. The side bars 39 taper from a minimum width of about 0.20 inch (dimension h in FIG. 5) near the forward end of the grating to a width of about 0.325 inch (dimension i in FIG. 5) near the scoop. Thus, the opening 38 in the grating is generally about 9 inches long and about 2.3 inches wide.

The grating is as streamlined as possible, with the top surface and bottom surface of the grating being generally continuous and uninterrupted from one end of the grating to the other. The side bars of the grating also are streamlined in that they are relatively narrow when viewed from above, as in FIG. 5; and when viewed in cross-section, as in FIG. 7, the side bars are smoothly and slightly curved convex outwardly on both sides of each arm.

I have discovered that the jet ski of this invention has a significantly higher speed than the Kawasaki jet ski Series JS 440-A referred to above. In comparative tests in which my jet ski was raced with a Kawasaki jet ski over a one mile course, my jet ski, on the average, was about 200 yards ahead of the Kawasaki jet ski by the finish of the race. The only difference between the two jet skis was that my jet ski used the grating described above, whereas the Kawasaki jet ski used a standard grating now being sold with Kawasaki jet skis. The Kawasaki grating has two parallel outside bars and a central rib extending parallel to and between the side bars. The aft end of the central rib is integrally formed with the scoop surface, forming two interrupted side-by-side openings adjacent the scoop on opposite sides of the central rib. The bottom surface of the Kawasaki grating does not project below the plane of the hull bottom surface.

I have discovered that superior performance over the Kawasaki jet ski is obtained when the uninterrupted bottom edge of the scoop in my jet ski projects below the hull bottom plane 34 by a vertical distance of between about 0.05 to 0.30 inch. Best performance is obtained when the vertical distance is between about 0.20 to 0.25 inch. I have also discovered that a shallower projection, i.e., in the neighborhood of about 0.05 to 0.1 inch below the plane of the hull, can provide increased performance over the Kawasaki jet ski for calm or smooth water conditions. However, for rough water conditions, as well as smooth water conditions, the 0.20 to 0.25 inch projection provides the best performance.

It was surprising to me that such improved performance was obtained from the grating of this invention, since a projection below the hull bottom could be thought to increase resistance or turbulence in the opening to the pump housing and reduce the speed of the ski. It was discovered that a scoop that projects about 0.3 to 0.6 inch below the hull bottom does result in poorer performance, probably owing to the greater turbulence. The grating of this invention keeps the hull of the ski down in the water more than the Kawasaki grating. A jet ski with a powerful engine tends to hop out of the water when traveling at high speeds, which causes the pump impeller to jump free of the water and reduce speed. Since my grating tends to keep the jet ski lower in the water, the jet ski does not have the same tendency to hop or skip out of the water, resulting in the higher speed.

What is claimed is:

1. A jet ski comprising:

a hull having a generally planar bottom surface;

a well formed in the planar bottom surface of the hull, an aft portion of the well having an opening facing a pump confined within the hull, the planar hull bottom surface having a forward portion adjacent a front portion of the well and an aft portion adjacent an aft portion of the well; and an elongated grating secured over the well, the grating having a pair of laterally spaced apart, elongated side bars extending generally lengthwise over the well for deflecting debris away from the well, an elongated opening extending between forward and aft ends of the grating between the side bars, and a scoop with an inclined surface at the aft end of the opening in the grating, the scoop having a concavely curved bottom edge extending laterally across the grating bottom surface between the side bars, the concave bottom edge of the scoop extending below the plane of the forward and aft portions of the hull bottom surface, the concave bottom edge being essentially at the point of maximum spacing between the bottom surface of the hull and the bottom surface of the grating, the concave bottom edge being continuous and uninterrupted across the width of the opening in the grating.

2. A jet ski according to claim 1 in which the concave bottom edge of the scoop extends for a substantial portion of its length below the hull bottom surface.

3. A jet ski according to claim 1 in which the concave edge of the scoop extends between about 0.05 to about 0.3 inch below the hull bottom surface.

4. A jet ski according to claim 1 in which the concave bottom edge of the scoop is continuous and uninterrupted between one side bar and the other.

5. A jet ski according to claim 4 in which the opening in the grating is entirely open between the side bars for the entire length of the side bars.

6. A jet ski according to claim 4 in which the aft portion of the grating is formed as a plate extending between the side bars; and the plate has a top surface which is generally continuous with the top surface of each side bar.

7. A jet ski according to claim 1 in which the surface of the scoop, at its center, extends at an angle of about 45° or greater relative to a vertical plane through the concave bottom edge of the scoop at the center of the concave edge.

8. A jet ski according to claim 1 in which the concave bottom edge of the scoop is continuous and uninterrupted for at least about $1\frac{1}{8}$ inch across the width of the opening in the grating.

9. A jet ski according to claim 1 in which the portion of the grating bottom surface extending from the aft end toward the concave bottom edge tapers farther from the hull bottom surface; and the portion of the grating bottom surface extending from the concave bottom edge toward the forward end of the grating tapers narrower toward the hull bottom surface.

10. In a jet ski having a hull with a generally planar bottom surface, a well in the hull bottom surface, the well having a front end and an aft end, a pump inside the hull aft of the well and exposed to the opening in the aft end of the well, the improvement comprising:

a grating secured over the well, the grating having a pair of laterally spaced apart, elongated side bars extending generally lengthwise over the well for deflecting debris away from the well, an elongated opening extending between forward and aft ends of the grating between the side bars, the grating having an inclined scoop surface adjacent the aft opening in the well, the inclined scoop surface intersecting a bottom surface of the grating to form a bottom edge extending across the width of the grating between the side bars, the bottom edge of the scoop being spaced below the plane of the hull bottom surface and being generally at the point of maximum spacing between the bottom surface of the hull and the bottom surface of the grating, said bottom edge of the scoop being essentially continuous and uninterrupted across the width of the opening in the grating.

11. The improvement according to claim 10 in which the bottom edge of the scoop extends for a substantial portion of its length below the hull bottom surface.

12. The improvement according to claim 11 in which the edge of the scoop extends between about 0.05 to about 0.3 inch below the hull bottom surface.

13. The improvement according to claim 12 in which the bottom edge of the scoop is concavely curved.

14. The improvement according to claim 13 in which the bottom edge of the scoop is continuous and uninterrupted for a distance of at least about $1\frac{1}{8}$ inch.

15. A jet ski according to claim 1 in which the aft end of the grating is secured adjacent the aft portion of the well, the forward end of the grating is secured adjacent the front portion of the well, and the opening in the grating is essentially uninterrupted from the surface of the scoop to the forward end of the grating.

16. The improvement according to claim 10 in which the aft end of the grating is secured adjacent the aft end of the well, the forward end of the grating is secured adjacent the front end of the well, and the opening in the grating is essentially uninterrupted from the surface of the scoop to the forward end of the grating.

17. The improvement according to claim 10 in which the bottom edge of the scoop is continuous and uninterrupted between one side bar and the other.

18. The improvement according to claim 17 in which the opening in the grating is entirely open between the side bars for the entire length of the side bars.

* * * * *